US011255140B2

(12) United States Patent
Kalisch et al.

(10) Patent No.: US 11,255,140 B2
(45) Date of Patent: Feb. 22, 2022

(54) DRILL ROD HANDLER

(71) Applicant: Wallis Engineers Pty. Ltd., Midvale (AU)

(72) Inventors: Paul Kalisch, Midvale (AU); Brendan Moran, Midvale (AU)

(73) Assignee: Wallis Engineers Pty. Ltd.

( * ) Notice: Subject to any disclaimer, the term of this patent is extended or adjusted under 35 U.S.C. 154(b) by 0 days.

(21) Appl. No.: 16/637,605

(22) PCT Filed: Aug. 8, 2018

(86) PCT No.: PCT/AU2018/050839

§ 371 (c)(1),
(2) Date: Feb. 7, 2020

(87) PCT Pub. No.: WO2019/028518

PCT Pub. Date: Feb. 14, 2019

(65) Prior Publication Data

US 2020/0190919 A1 Jun. 18, 2020

(30) Foreign Application Priority Data

Aug. 9, 2017 (AU) ..... 2017903162

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/06; E21B 25/005; E21B 25/02; B66C 23/94; E02F 3/388;
(Continued)

(56) References Cited

U.S. PATENT DOCUMENTS 1,073,613 A * 9/1913 Maynard ..... C03B 15/14 65/189
3,280,920 A * 10/1966 Scott ..... E21B 19/155 173/44

(Continued)

FOREIGN PATENT DOCUMENTS

AU 2005202267 A1 12/2005
DE 19852500 A1 * 5/2000 ..... E21B 19/155

(Continued)

OTHER PUBLICATIONS

English Translation, DE 10344523 A1 (Year: 2005).*

(Continued)

*Primary Examiner* — Gregory W Adams
(74) *Attorney, Agent, or Firm* — Kim IP Law Group LLC

(57) ABSTRACT

A drill rod handler (30) for use on a drilling rig (10). In at least one embodiment, the drill rod handler (30) comprises a boom (32) having jaws (38) for releasably grasping a drill rod (14) in at least two spaced apart positions along the length of the drill rod, and a boom positioning means for positioning the boom so that the jaws may grasp a drill rod (14) from a rod storage (18) on the drilling rig or from another rod storage at a different location (16). In another embodiment, a drill rod handler comprising a boom having jaws for releasably grasping a drill rod in at least two spaced apart positions along the length of the drill rod, a boom tilt mechanism for raising or lowering an end of the boom and a drill rod when the drill rod is grasped by the jaws; and an interconnect for connection to the end of the boom for stabilising the end of the boom with respect to the a mast (20) of the drilling rig (10) when the boom (32) is in a rod presentation position.

23 Claims, 12 Drawing Sheets

(58) Field of Classification Search
CPC ..... E02F 3/382; E02F 3/3604; B63B 27/16; B63B 35/44; B63B 2221/02; B63B 2231/04; B63B 2231/50; B25J 15/0052
See application file for complete search history.

(56) References Cited

U.S. PATENT DOCUMENTS 3,659,661 A * 5/1972 Young ..... E21B 19/20 175/85
3,734,208 A 5/1973 Otto
3,734,209 A * 5/1973 Haisch ..... E21B 19/20 175/57
3,994,350 A * 11/1976 Smith ..... E21B 19/084 175/85
4,303,270 A 12/1981 Adair
4,407,629 A * 10/1983 Willis ..... E21B 19/155 175/52
4,482,289 A * 11/1984 Inaba ..... B25J 15/0052 294/81.2
4,547,110 A * 10/1985 Davidson ..... E21B 19/15 294/104
4,834,604 A * 5/1989 Brittain ..... E21B 19/155 175/85
5,423,390 A * 6/1995 Donnally ..... E21B 19/14 175/85
5,941,324 A 8/1999 Bennet
6,298,927 B1 10/2001 Back
7,469,754 B2 * 12/2008 Landry ..... E21B 15/04 173/185
8,157,495 B1 4/2012 Randall
8,186,925 B2 * 5/2012 Littlely ..... E21B 19/155 414/22.55
8,240,968 B2 * 8/2012 Hopkins ..... E21B 19/155 414/22.55
8,419,335 B1 4/2013 Orgeron
8,905,160 B1 * 12/2014 Verzilli ..... E21B 19/155 175/85
9,500,049 B1 11/2016 Orgeron et al.
2009/0238663 A1 9/2009 Littlely
2013/0037324 A1 * 2/2013 Milivojevic ..... E21B 19/155 175/24
2013/0341000 A1 12/2013 Flusche
2013/0341036 A1 12/2013 Flusche
2014/0209382 A1 * 7/2014 Smith ..... E21B 19/14 175/24

FOREIGN PATENT DOCUMENTS

DE 10344523 A1 * 4/2005 ..... E21B 19/155
DE 202015009111 U1 10/2016
EP 919692 A2 * 6/1999 ..... E21B 19/14
GB 2139269 A 11/1984
GB 2264736 A 9/1993
WO 9322535 A2 11/1993
WO 9855728 A1 12/1998
WO WO-2010046757 A1 * 4/2010 ..... E21B 7/023
WO 2010062613 A2 6/2010
WO 2011016719 A1 2/2011
WO 2011120627 A2 10/2011
WO 2013116440 A2 8/2013
WO 2014183929 A1 11/2014
WO 2015157815 A1 10/2015

OTHER PUBLICATIONS

International Search Report dated Nov. 2, 2018 in International Patent Application No. PCT/AU2018/050839.
Written Opinion dated Nov. 2, 2018 in International Patent Application No. PCT/AU2018/050839.
International Preliminary Report on Patentability dated Nov. 22, 2019 in International Patent Application No. PCT/AU2018/050839.
European Patent Office, European Search Report in EP Patent Application No. 18842888.2, dated Mar. 18, 2021.

* cited by examiner

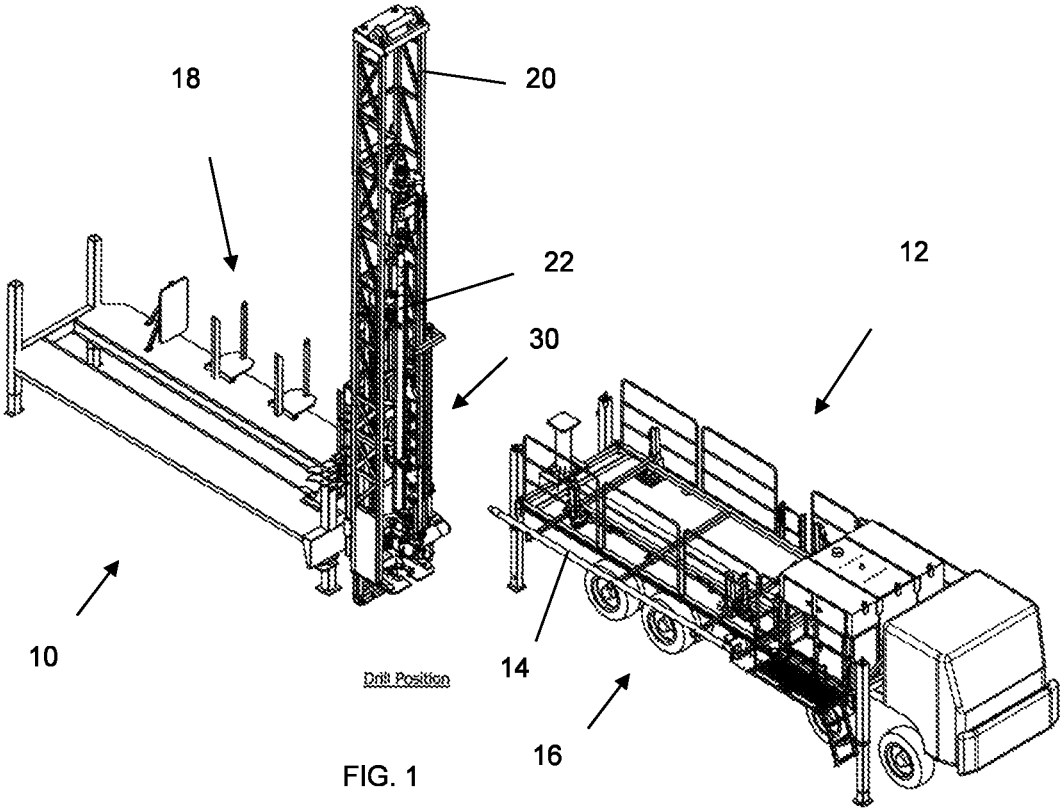
FIG. 1
FIG. 2
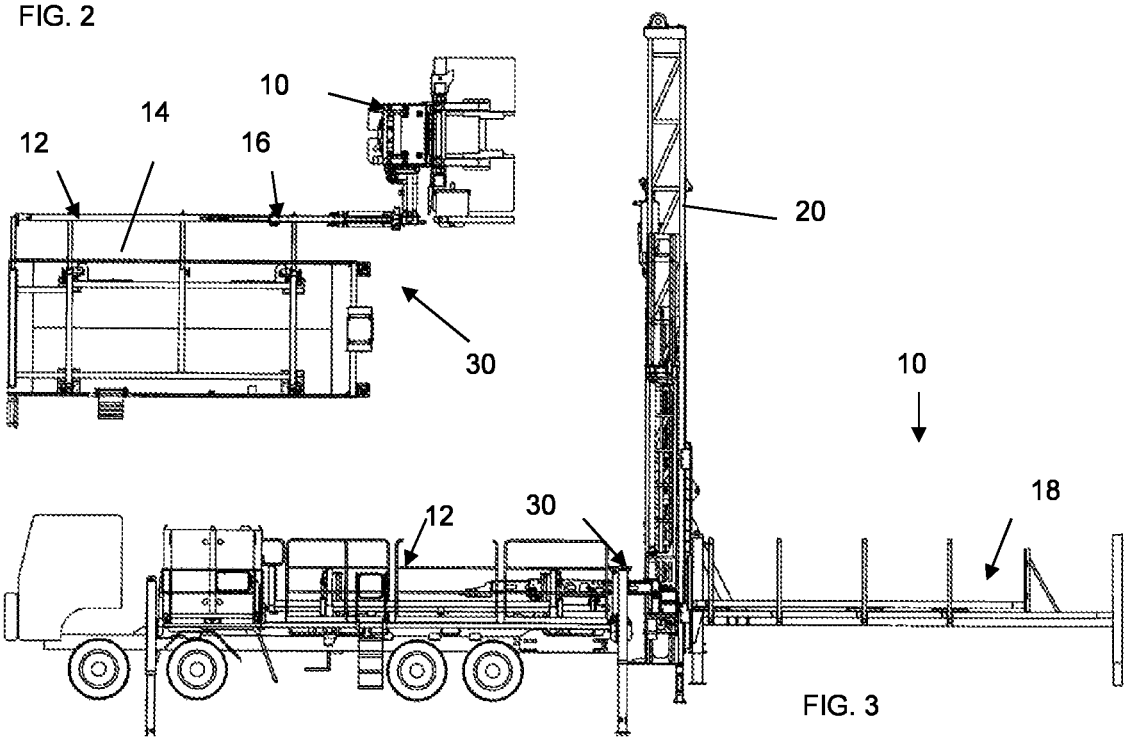
FIG. 3

Handling Rods From Rod Bin, Vertical Hole

Handler Parked Parallel To Mast, Ready To Load Rod Into Mast

Handling Rods From Rod Bin, 45° Hole

45° Hole, Loading Rod From Top Of Rod Bin

DRILL ROD HANDLER

FIELD OF THE INVENTION

The present invention relates to a handler for loading and unloading of drill rods from a storage position to an operational position on a drill rig.

BACKGROUND

Drill rigs are used for exploratory drilling in the field of mineral, and oil and gas exploration, along with other applications, such as drilling for water. The drill rig comprises a mast that handles a string of drill rods that is progressively built as the drill string drills its way into the earth. As the current drill rod is lowered into the ground by the drilling operation, it will be necessary to add another rod to the drill string. A rod handler is used to take the next drill rod from a storage bin and place it in an operational position for attachment to the end of current drill string so as to extend the length of the drill string once the new rod is attached. The rod handler also returns the rod to the rod storage bin as the string is disassembled.

Sandvikù has a rod handler that has a boom with a cup at one end. A set of jaws is able to grasp the rod and move along the length of the boom towards the cup so as to insert an end of the rod into the cup. The boom is connected to a slew arm that is able to pivotally raise the boom. The slew arm is connected to a mast traveller in a manner that allows pivotal movement of the slew arm so as to slew the boom and thus the rod into an operational position relative to the mast. Further, the mast traveller is able to travel up and down the length of the mast.

Sandvik also has an international patent application published under WO2014/183929 directed to substantially the same rod handler described above, but with the addition of an alignment tool to align the rod with the an end of a drill string.

Foremostù has a rod handler that has a boom with a pair of spaced apart jaws able to grasp the rod. The boom is connected to a slew arm at a point between the sets of jaws that is able to pivot the boom. The slew arm is connected to an axle that is able to axially rotate so as to slew the boom and thus the rod into an operational position relative to the mast. The axle is able to traverse in parallel with and up and down the length of the mast.

Boart Longyear™ has a rod handler that has a pair of spaced apart jaws is able to grasp the rod, with each of the sets of jaws being on either side of a slew arm that is able to pivot the orientation of the jaws relative to the length of the slew arm. The slew arm is connected to an axle that is able to axially rotate so as to slew the boom and thus the rod into an operational position relative to the mast. The axle is able to traverse in parallel with and up and down the length of the mast. There is also a small grabber jaw on a removable boom that reaches to and draws a rod back to the spaced apart jaws.

The present invention seeks to provide a new rod handler.

SUMMARY OF THE INVENTION

According to an aspect of the invention there is a drill rod handler for use on a drilling rig comprising:

a boom having jaws for releasably grasping a drill rod in at least two spaced apart positions along the length of the drill rod;

a boom positioning means for positioning the boom so that the jaws may grasp a drill rod from either of a rod storage on the drilling rig or from another rod storage at a different location.

According to another aspect of the invention there is a drill rod handler for use on a drilling rig comprising:

a boom having jaws for releasably grasping a drill rod in at least two spaced apart positions along the length of the drill rod;

a boom tilt mechanism for raising or lowering an end of the boom and a drill rod when the drill rod is grasped by the jaws; and an interconnect for connection to the end of the boom for stabilising the end of the boom with respect to the mast when the boom is in a rod presentation position, the connection of the interconnect to the end of the boom configured such that the interconnect is moveable with respect to the mast.

In an embodiment, the rod handler further comprises a boom swivel mechanism for changing the facing of the rod from a lift facing to a rod presentation facing.

In an embodiment, when the end of the boom is lowered and the boom swivelled so that the jaws face downward, the jaws may be positioned to grasp, or release a drill rod.

In an embodiment, the boom swivel mechanism is able to change the facing of the drill rod, from a lift position in which it has the lift facing to the rod presentation position where it has the rod presentation facing. The rod presentation facing allows a drill interface to attach to the drill rod and to take the drill rod to an operational position.

In an embodiment, the connection of the interconnect to the end of the boom connects the end of the boom relative to the mast, thereby stabilising the end of the boom with respect to the mast is transverse to the length of the boom and longitudinal directions. In an embodiment, the stabilisation of the end of the boom is in two orthogonal directions transverse to the length of the boom.

In an embodiment, the boom comprises a boom carriage for carrying the jaws on the boom. In an embodiment the boom carriage is configured to travel along the length of the boom.

In an embodiment, the mast comprises a mast carriage for carrying the boom tilt mechanism on the mast. In an embodiment, the mast carriage connects the interconnect to the mast. In an embodiment, the mast carriage is configured to travel along the length of the mast so that the position of the tilt mechanism (and thus the boom) with respect to the mast is able to change. In an embodiment, the mast carriage operates as a height adjuster of the height of the boom relative to the mast. Advantageously, this permits the presenting a drill rod at the same relative height on a mast when the mast is at an acute angle to vertical.

In an embodiment, the boom swivel mechanism is configured to pivot about an axis that is axially spaced from a line through the jaws.

In an embodiment, the boom tilt mechanism moves the boom so that the rod may be deposited in either of the rod storage on the drilling rig or the other rod storage.

In an embodiment, the drill hold handler also comprises a boom positioning means for moving the boom so that the drill rod may be moved to an operating position on the drilling rig.

In an embodiment, the boom positioning means comprises a slew means for slewing the boom relative to a mast of the drilling rig. In an embodiment, the slew means comprises a first slew arm. In an embodiment, the slew means comprises a second slew arm. In an embodiment, the second slew arm is releasably attachable to the boom.

In an embodiment, the slew means comprises a pivotal coupling of a first end of the slew arm to the mast carriage. In an embodiment, the slew arms are configured to move the jaws into or out of the operational position.

In an embodiment, the height adjuster comprises a first track for coupling the mast carriage to the mast and the mast carriage is able to travel along the first track so as to position the boom tilt mechanism at a desired height.

In an embodiment, the boom tilt mechanism is configured to pivotally raise or lower the boom to or from one or more storages. In an embodiment, the boom tilt mechanism is configured to allow the boom to be positioned at a selected angle relative to horizontal.

In an embodiment, the boom swivel mechanism comprises a rotary actuator or motor driven pivot for positioning the jaws in an orientation relative to the mast according to the position of the rod storage from which the rod is to be taken or into which the rod is to be deposited.

In an embodiment, the boom swivel mechanism is orthogonally pivotal relative to the boom tilt mechanism.

In an embodiment, the interconnect further comprises a rod aligner for aligning the rod in the presentation position.

In an embodiment, the rod aligner comprises an extendable support for engaging the upper end of the boom. In an embodiment, the upper end of the boom comprises a post for engagement with the extendable support.

In an embodiment, the rod aligner comprises the second slew arm, wherein the second slew arm is able to releasably engage an upper end of the boom. In an alternative, the rod aligner comprises an arm constrained in relation to the mast carriage, wherein the fixed arm is able to releasably engage an upper end of the boom. In an embodiment, the constraint is such that longitudinal movement relative to the mast carriage is limited or substantially prevented. In an embodiment, when the rod aligner engages the post, the upper end of the boom is substantially prevented from movement relative to the mast carriage in any direction.

In an embodiment, the second slew arm is coupled to the first slew arm by an axle coupled to the elongate carriage such that the slew arms slew the boom in unison when the second slew arm engages the boom.

In an embodiment, the jaws are configured to traverse along at least a portion of the length of the boom.

In an embodiment, the boom comprises a reach means. In an embodiment, the reach means is in the form of a runner able to travel along the boom, wherein the runner carries the jaws. In an embodiment, the reach means comprises the boom carriage.

In an embodiment, the extendable support releases engagement of the post of the boom so as to disengage the boom when the boom tilt mechanism, is to be operated.

In an embodiment, the boom swivel mechanism configures the jaws to face the mast end of the drilling rig in the presentation position. In an embodiment, the boom swivel mechanism is configured to rotate the jaws when the rod is to be taken from the rod storage of the drilling rig.

In an embodiment, the boom swivel mechanism is not operated when the rod is to be taken from the other storage. In an embodiment, the jaws face the mast end of the drilling rig when the rod is to be taken from the other storage. In an embodiment, the boom swivel mechanism is configured to position the jaws to face in a desired radial direction relative to an axis of rotation of the boom.

According to another aspect of the invention there is provided a drill rod handler for use on a drilling rig comprising:

a boom having jaws for releasably grasping a drill rod;

a boom positioning apparatus for positioning the boom so that the jaws may grasp a drill rod from a rod storage on the drilling rig or from another rod storage at a different location, wherein the boom positioning means comprises a first slew arm and a second slew arm, wherein the second slew arm is releasably attachable to the boom.

According to another aspect of the invention there is provided a method of handling a rod, comprising:

grasping a drill rod with jaws coupled to a boom;

pivoting the boom to pivotally lift the rod;

connecting the top of the boom to the mast to stabilise the boom relative to the mast.

In an embodiment, the method further comprise presenting the drill rod from the boom so that a drill connection can take the drill rod from the boom.

According to another aspect of the invention there is provided a method of handling a rod, comprising:

grasping a drill rod with jaws coupled to a boom;

pivoting the boom to pivotally lift the rod;

slewing the rod to an operative position on a drilling rig.

In an embodiment, the method further comprises adjusting the height of the boom relative to a mast of the drilling rig. In an embodiment, adjusting the height of the boom occurs when the rod is grasped, but before the boom is pivotally lifted. In an embodiment, adjusting the height of the boom occurs after the boom is pivotally lifted.

In an embodiment, the method further comprising engaging a free end of the boom, such that slewing of the boom occurs at spaced apart positions on the length of the boom.

In an embodiment, the method further comprises altering the facing of the boom prior to the boom being in the operative position.

In an embodiment, the method further comprises determining whether the facing of the boom needs to be altered based on the position of a rod storage from which the rod is grasped. In an embodiment, when it is determined that the facing of the boom needs to be altered, moving the facing of the boom.

According to another aspect of the invention there is provided a method of handling a rod, comprising:

grasping a drill rod with jaws coupled to a boom;

slewing the drill rod from an operative position on a drilling rig to a position according to the location of a rod storage in which the rod is to be deposited;

pivoting the boom to pivotally lower the rod on to the rod storage; and releasing the grasp on the drill rod.

In an embodiment, the method further comprises adjusting the height of the boom relative to a mast of the drilling rig. In an embodiment, adjusting the height of the boom occurs before the boom is pivotally lowered. In an embodiment, adjusting the height of the boom occurs after the boom is pivotally lowered.

In an embodiment, slewing of the boom occurs at spaced apart positions on the length of the boom and the method further comprising releasing a free end of the boom such that the boom may be pivotally lowered.

In an embodiment, the method further comprises altering the facing of the boom prior to the boom being pivotally lowered.

In an embodiment, the method further comprises determining whether the facing of the boom needs to be altered based on the position of the rod storage.

In an embodiment, the drill rod handler is controlled by a computer system configured to actuate motors so as to:

grasp the drill rod with jaws coupled to the boom;

move the drill rod from the operative position on the drilling rig to the position according to the location of the rod storage in which the rod is to be deposited;

pivot the boom to pivotally lower the rod on to the rod storage; and release the grasp on the drill rod.

In an embodiment, the drill rod handler is controlled by a computer system configured to actuate motors so as to:

grasp the drill rod with jaws coupled to the boom;

tilt the boom to a desired position, swivel the boom to a desired position;

release the grasp on the drill rod.

In an embodiment, the rod handler comprises sensors for detecting the position of the rod during movements so that the handler is operated under the control of a processor of the computer system.

Also according to the present invention there is provided a drilling rig comprising the rod handler as defined in any one or more of the aspects described above or employing any one or more of the methods described above.

In this specification the terms 'having,' 'comprising' or 'comprises' are used inclusively and not exclusively or exhaustively.

DESCRIPTION OF DRAWINGS

In order to provide a better understanding of the present invention preferred embodiments will now be described, by way of example only, with reference to the accompanying drawings, in which:

FIG. 1 is a perspective view of a drill rod carrying truck and a drilling rig, on which is an embodiment of a rod handler according to the present invention;

FIG. 2 is a plan view of a mast end portion of the drilling rig and a rear end portion of the truck of FIG. 1;

FIG. 3 is a side elevation of the drilling rig and truck of FIG. 1;

DETAILED DESCRIPTION OF EMBODIMENTS OF THE INVENTION

Figure 4:
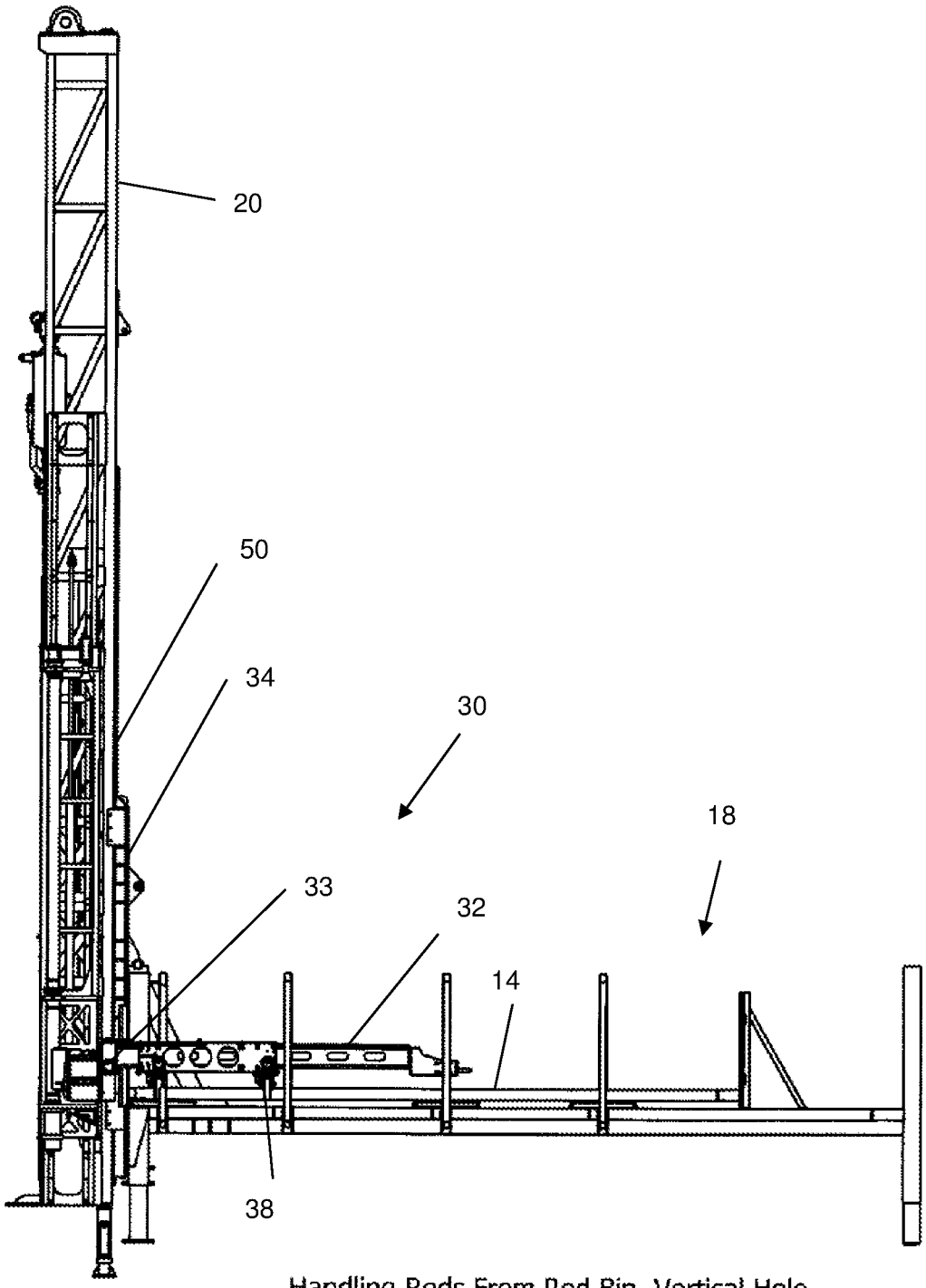
FIG. 4 is a side elevation of the drilling rig of FIG. 1 in which the mast is oriented to drill a substantially vertical hole and the rod handler is taking a rod from the rod storage bin.

Referring to FIGS. 1 to 4, there is shown a drilling rig 10 comprising a mast 20. The drilling rig 10 has a drill rod storage 18 for storing drill rods used in the drilling operation. The rod storage 18 may be in the form of a bin. Also shown is a drill rod truck 12 that has a drill rod storage 16 also for storing drill rods used in the drilling operation. The rod storage 16 may be in the form of a bin. The drill rod truck 12 is positioned relative to the rig 10 so that the storage 16 is close to the mast 20. The storage 16 is shown carrying a drill rod 14. It will be appreciated that storages 16 and 18 will usually hold many rods that are able to be used in the drilling operation.

The drilling rig 10 comprises a drill rod handler 30 for taking a rod from either storage 16 or 18 and then positioning the taken rod 14 in an operational position relative to the mast 20 for use in the drilling operation as indicated by 22. The drill rod handler 30 is also used for taking a rod from the operational position and then placing it in either storage 16 or 18 once it is no longer required in the drilling operation. The taking or returning of rods to or from the storages 16 and 18 may be repeated as required.

The drill rod handler 30 comprises a boom 32 having spaced apart jaws 38 for releasably grasping a drill rod 14 and a boom positioner for positioning the boom 32 so that the jaws 38 may grasp the drill rod 14 from the rod storage 18 or from another rod storage at a different location, such as storage 16.

In this first embodiment, the boom positioner comprises a slew mechanism for slewing the boom 32 relative to the mast 20. In an embodiment, the boom positioner comprises a height adjuster for adjusting the height of a slew arm relative to an end of the mast 20. In an embodiment, the boom positioner comprises a boom pivot mechanism for pivotal raising or lowering of the boom 32.

Figure 5:
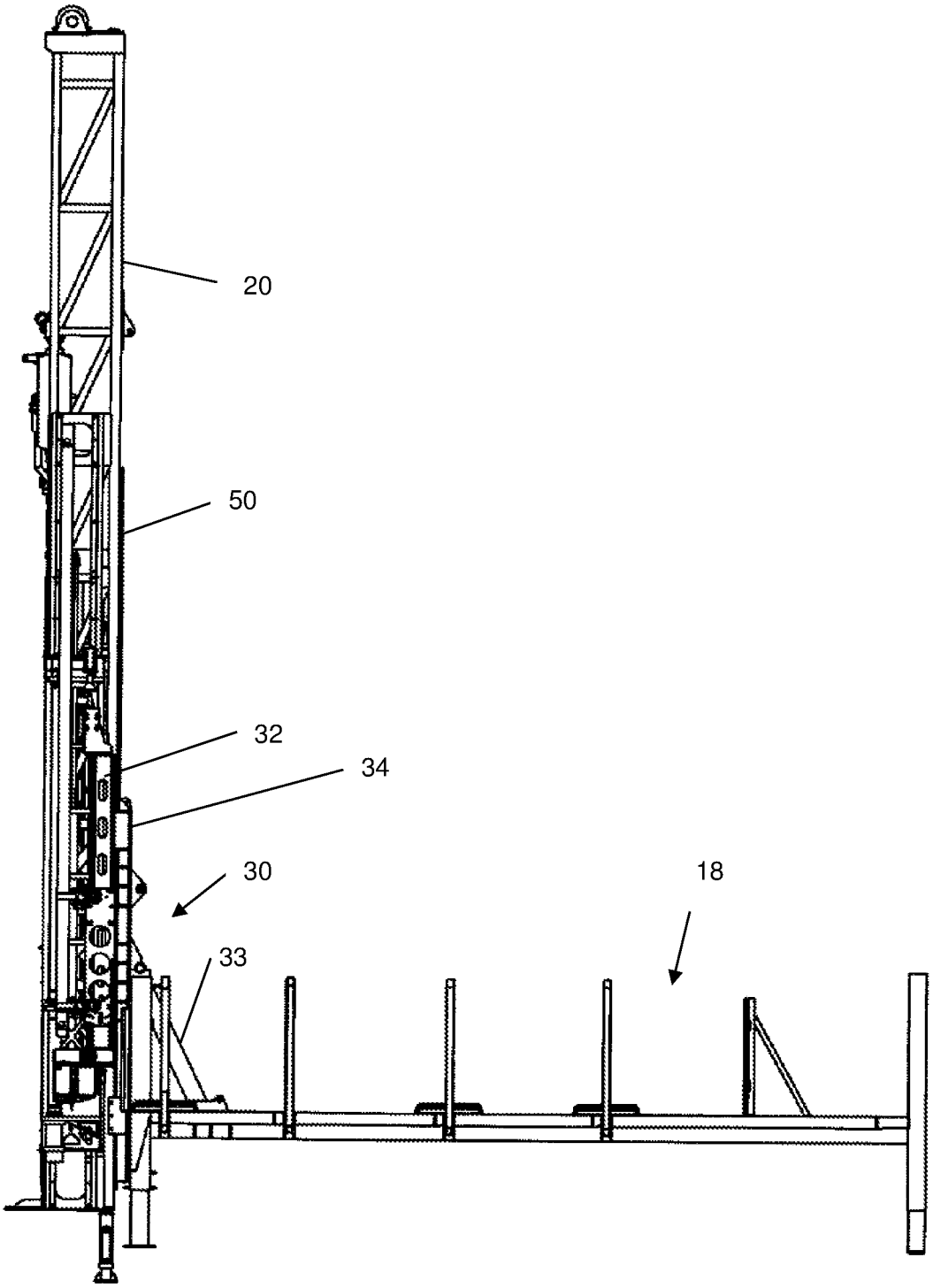
FIG. 5 is a side elevation of the drilling rig of FIG. 1, in which the rod handler has lifted the rod to be substantially parallel with the mast.
Figure 8:
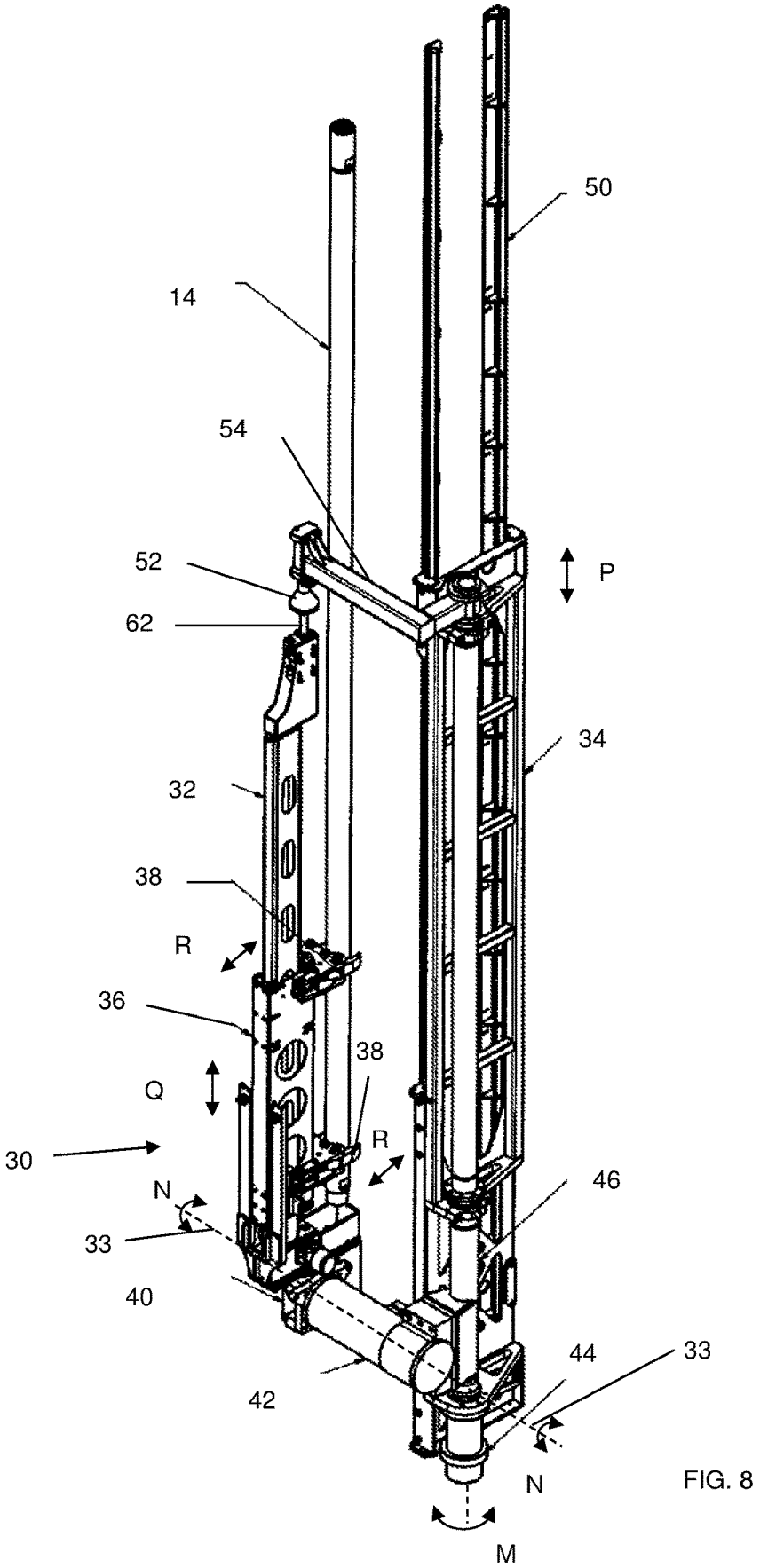
FIG. 8 is an upper isometric view of the rod handler of FIG. 1, with the mast deleted and the rod positioned in an operation position ready for use in a drill string.

Referring to FIG. 8, the height adjuster comprises a carriage 34 movable along a track 50 attached to the mast 20 so that the carriage 34 is movable along at least a part of the length of the mast 20 as indicated by arrow P. The boom pivot mechanism is configured such that the boom 32 is pivotable generally at one end about an axis 33 so that the boom 32 can be pivotally lowered down to the storage 18 and/or storage 16 as indicated by arrow N. This enables the boom 32 to be lowered to grasp a drill rod 14 from the storage 18 as shown in FIG. 4. The boom 32 can be pivotally raised from the storage 18 to be parallel with the mast 20 as shown in FIG. 5. The slew mechanism is configured so that the boom 32 can then the pivotally slewed into and out of an operational position, as indicated by arrow M, for use in the drilling operation as shown in FIG. 8, and as described in more detail below.

Figure 6:
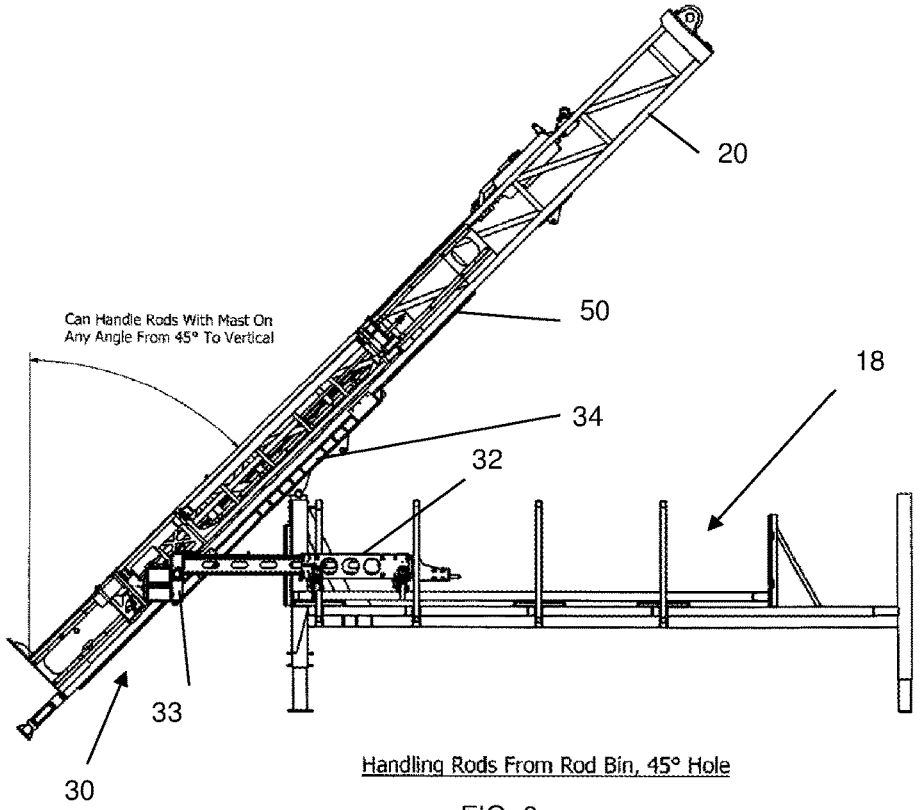
FIG. 6 is a side elevation of the drilling rig of FIG. 1 in which the mast is oriented to drill a hole at about 45é from vertical and the rod handler is taking a rod from the rod storage bin.

In some cases the mast 20 will be positioned at an angle to the vertical due to operational drilling requirements. For example, in FIG. 6 the mast is at a 45 degree angle to the vertical. When a new drill rod is required, the boom 32 is pivoted down to the storage 18 or 16. The storage 18 or 16 is still generally horizontal, so the angle of the boom 32 relative to the mast will be about 45 degrees when the rod 14 is grasped.

Figure 7:
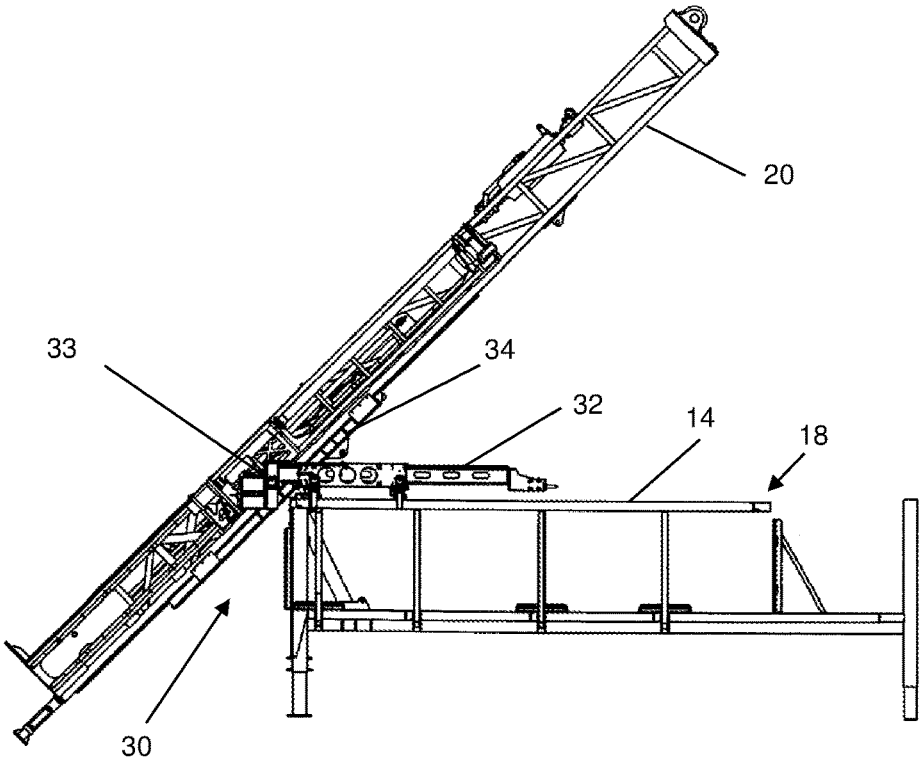
FIG. 7 is a side elevation showing the drilling rig of FIG. 6 showing the rod handler taking a rod from the top of the rod storage bin.

As shown in FIG. 7, the storage 18 may have side walls so that a number of rods can be held. In this embodiment, the side walls are formed by upwardly extending posts, which in combination form the side wall. As a result, the rod 14 may need to be lifted from different heights in the storage 18. This can be accommodated by the carriage 34 travelling up the track 50 (and thus up the mast 20) thereby raising the pivot point 33 and thus the lower end of the boom 32. In an embodiment, the storage 18 may be provided with means for offering the drill rod to the rod handler 30.

Referring to FIG. 8 again, in which the components of the drill rod handler 30 can be seen in more detail. The boom 32 is slewed relative to the carriage 34 by a first slew arm 42. The height of the first slew arm 42 is able to be adjusted relative to the mast 20 by the carriage 34 travelling on the track 50 coupled to a side of the mast 20. A slew axle 46 is rotationally coupled to the carriage 34 and the first slew arm 42 is coupled to the axle 46 at one end. A rotary actuator 44 causes the axle 46 to axially rotate such that the other end of the first slew arm 42 is able to move in the arc around the axle 46 indicated by arrow M.

The first slew arm 42 is able to axially swivel between the ends of its length so as to rotate the boom 32 about the axis of rotation 33 as indicated by arrow N. In an embodiment, the first slew arm 42 is in the form of an axial actuator.

At the end of the first slew arm 42, distant from the axle 46, is a swivel mechanism for positioning the jaws 38 so as to face the mast 20 or in a generally opposite direction. This means it is in the form of a rotary actuator 40 axially connected to the boom 32 so as to move the boom 32 as indicated by arrow O, in FIG. 9. The boom 32 comprises a boom carriage 36 or runner that is able to traverse the length of the boom 32 as indicated by arrow Q. The boom carriage 36 carries jaws 38 able to grasp the rod 14. Further, the boom carriage 36 is able to tilt relative to the boom 32 to account for a misalignment so that each end is independently, controllably able to move as indicated by arrows R.

Figure 11A:
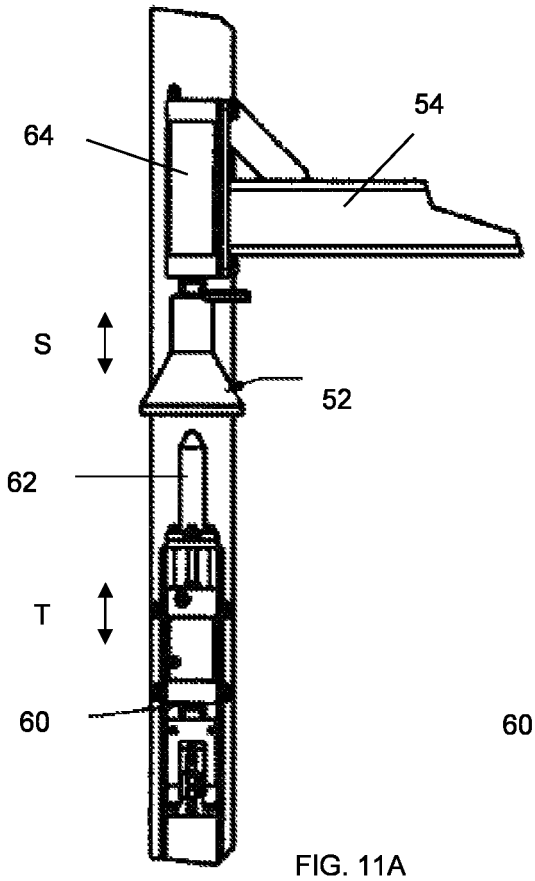
FIG. 11A is an enlarged view of the area A in FIG. 9, with a support retracted.
Figure 11B:
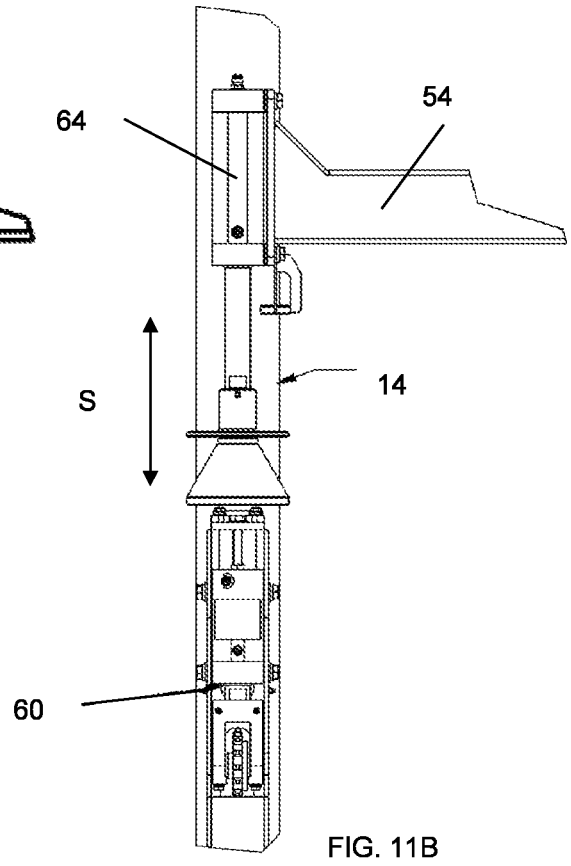
FIG. 11B is an enlarged view of the area A in FIG. 9, with the support extended over a post of the boom.
Figure 12:
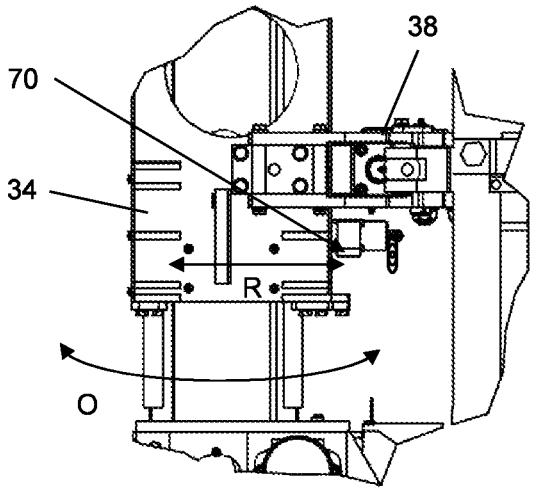
FIG. 12 is an enlarged view of the area B in FIG. 10.

The upper end of the boom 32 comprises a post 62 which may be engaged by a support 52 at the end of a second slew arm 54. In an embodiment the support 52 is cone, umbrella or bell shaped so as to receive the post 62, even if the boom 32 is deflected. The second slew arm 54 is coupled to the axle 46 and slews in unison with the first slew arm 42. The support 52 is telescopically extendable so as to engage or disengage with post 62 as indicated by arrow S, in FIG. 11.

The drill rod handler 30 may be controlled by a computer system configured to actuate motors so as to perform the movements indicated above so that the handler 30 can be operated as will be described in more detail further below. The rod handler 30 may have sensors for detecting the position of the various components described above so that the handler 30 can be operated under the control of a processor of the computer system as will be described in more detail further below.

Sensors may be, for example, positioned as follows:

Along the length of the track 50 so that there is feedback to the processor on the position of the carriage 34 along the line indicated by arrow P;

On the axle 46 so that the rotational position of the axle 46 relative to the carriage 34 (and within the arc indicated by arrow M) is known by the processor;

Within the slew arm 42 so that the rotational position of the boom 32 relative to the mast 20 (or carriage 34) (and within the arc indicated by the arrow N) is known by the processor;

On or around the coupling of the boom 32 to the slew arm 42 so that the rotational position of the boom 32 relative to the first slew arm 42 (and within the arc indicated by arrow O) is known by the processor;

Along the length of the boom 32 so that the position of the boom carriage 36 along the length of the boom 32 as indicated by arrow Q is known by the processor;

On the boom carriage 36 so that the position of the carriage 36 within the plane of the carriage 36 and perpendicular to the direction of arrow Q relative to the boom 32 (and within the plane through which parallel arrows R pass) is known by the processor;

Where the jaws 38 are extendable within the plane through which the arrows R pass, on the carriage 36 so that the position of the extension of each jaw 38 is known by the processor;

On the jaws 38 so that the state or degree by which each jaw is opened or closed is known by the processor; and On the support 52 so that the extension of the support 52 relative to the second slew arm 54 within the line indicated by arrow 5 is known by the processor.

The sensors may take a number of suitable forms, such as switches, optical sensors, variable resistors, capacitive sensors, and the like, as will be appreciated by those skilled in the art. These sensors will produce a respective signal that is input to the processor.

A computerised control system comprises the processor, inputs from the sensors, input from a user, outputs to the actuators and an output to the user. The processor is configured to process signals received at the inputs and to send signals to the outputs to control the actuators in a manner that controls the rod handler 30 to be operated as described below. In one embodiment, the processor is an electronic circuit wired to operate as described below. In another embodiment, the processor is controlled by the execution of a computer readable code stored on a memory device, such as a solid state memory device, hard disk drive, optical storage medium. The code comprises instructions for controlling the processor.

The method of operation and use of the rod handler 30 will now be described in more detail with reference to the figures.

Referring to FIGS. 1 to 3, a drill rig 10 is in an operational position for a drilling operation and in need of a drill rod to add to the drill string. In this example, there are two locations from which the drill rod may be taken. The first is in the rod storage 18, the second is in the rod storage 16 that is on the truck 12. Depending on the required length of the drill string additional rods may be required, in which one or more other trucks carrying further rods in their respective rods storages may replace the first or subsequent truck. In an alternative example the truck 12 may be positioned differently to that shown in FIG. 1 to 3. This alternative will be described in more detail further below in relation to the example shown in FIG. 13.

Figure 9:
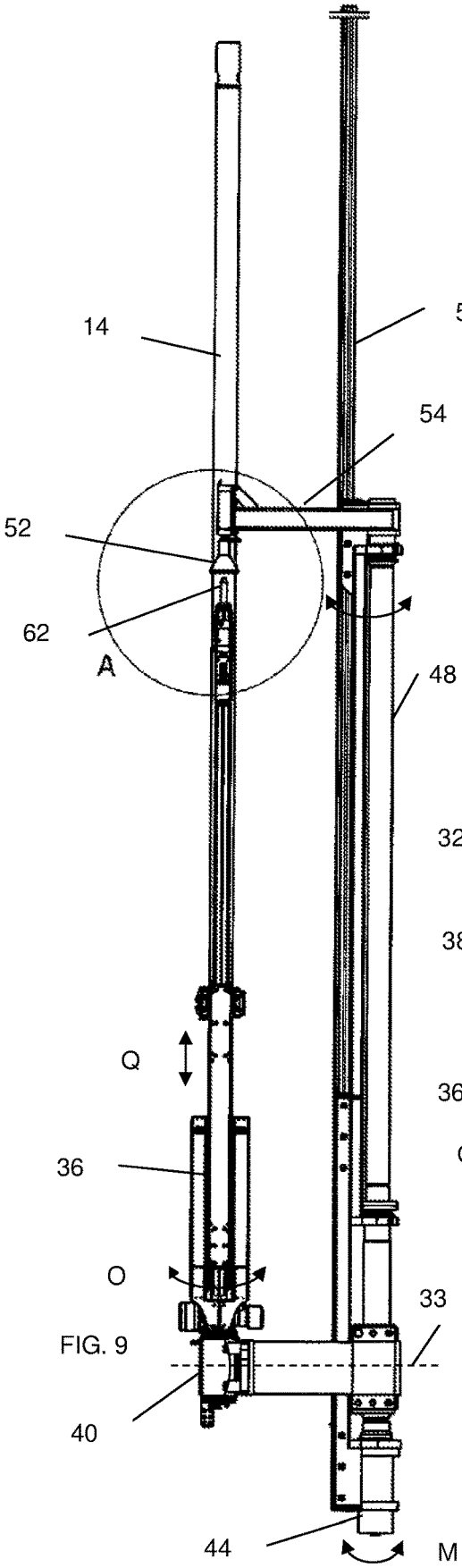
FIG. 9 is a front elevation of the rod handler of FIG. 8.
Figure 10:
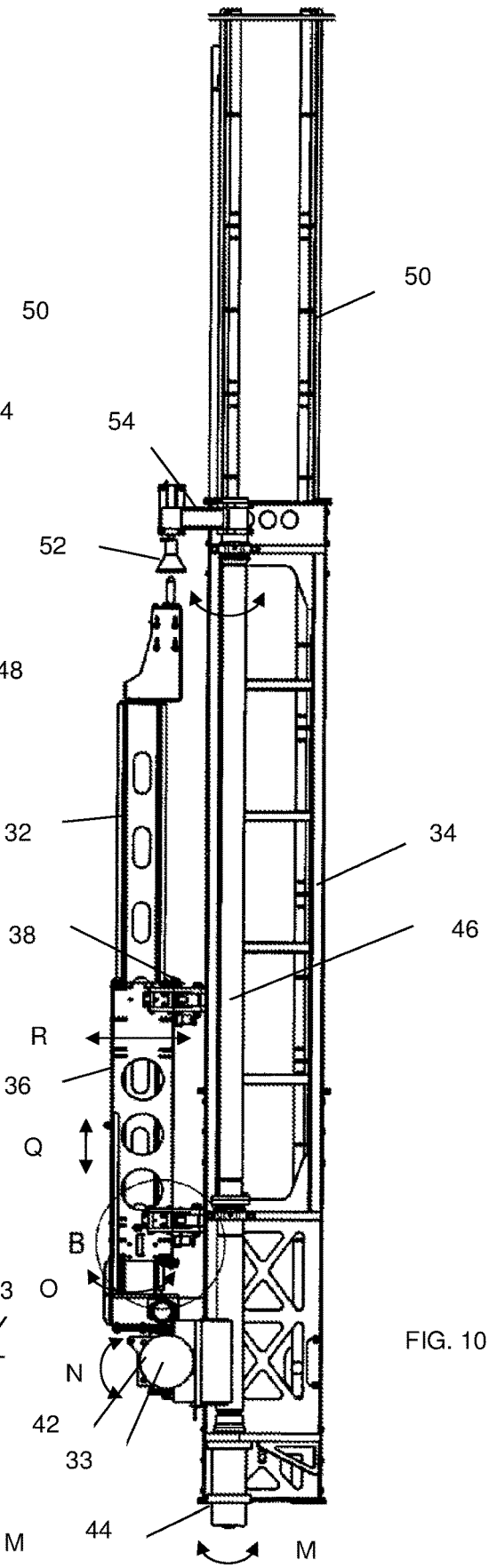
FIG. 10 is a side elevation of the rod handler of FIG. 8.

It is assumed that the rod handler 30 starts from a position with the boom 32 slewed into the mast 20 as is shown in FIGS. 8 and 9. However the boom 32 may be in a different starting position.

The boom 32 is then slewed out of the mast 20 by activation of the actuator 44 so as to rotate the slew axle 46, which in turn slews the slew arms 42 and 54. A sensor associated with the actuator 44 or axle 46 is sampled so as to monitor the rotational position of the axle 46. Under the control of the processor, the axle 46 is rotated as indicated by arrow M through about 180 degrees so that the boom 32 is beside the mast 20.

The sensor associated with the support 52 is sampled to determine whether the support 52 has been lowered. The support 52 is raised, if necessary, so that the post 62 is free of the support 52. Thus, the upper end of the boom 32 is free. The sensor associated with the support 52 is sampled to ensure the support 52 is free of the post 62.

The user may provide an input to the user input device to indicate to the processor that the rod 14 should be taken from the rig storage 18. Thus taking a rod from the rig 10 will be described first.

Due to the jaws 38 facing the non-mast end of the rig 10 when slewed into position for a drilling operation, and then slewed out so as to be beside the mast 20, the jaws 38 will be facing in the wrong direction to take the rod 14 from the rig storage 18. Accordingly under the control of the processor the boom 32 is rotated as indicated by arrow O through about 180 degrees by activation of the actuator 40. A sensor associated with the actuator 40 or boom 32 is sampled so as to monitor the rotational position of the boom 32 so that the boom 32 and thus the jaws 38 are facing the other way, that is, towards the storage 18. This movement may occur after or simultaneously with the slewing of the boom 32.

Depending on the height of the rod to be taken relative to the height of the axis of rotation 33 and the angle of the mast 20 relative to vertical, two other movements may be required. These may occur sequentially or simultaneously with or after the slewing of the boom 32 or changing of direction of the boom 32. The first movement is raising or lowering of the carriage 34 relative to the mast 32. The second movement is changing the angle of the boom 32 relative to the mast 20. In the first of these movements, under the control of the processor, a motor is actuated that causes the carriage 34 to run along the track 50 as indicated by arrow P. One or more sensors associated with the track 50 or carriage 34 report on the position of the carriage 34 relative to the track 50. In the second of these movements, under the control of the processor, the actuator in the slew arm 42 is actuated so as to cause the boom 32 to rotate about axis 33 as indicated by arrow N so as to be substantially horizontal. Thus the boom 32 can be positioned for example as indicated initially in FIG. 5 to any of the positions shown in the examples of FIG. 4, 6 or 7.

Thus, if the rod is higher in the storage 18 the boom 32 can be positioned higher on the mast 20. Further, if the mast 20 is tilted off vertical, the boom 32 can still be positioned so as to be horizontal. Indeed the storage 16 may not be horizontal, so that can also be accounted for by the boom being parallel to the storage 16 instead of horizontal.

Further depending on the distance of the axis of rotation 33 from the end of the storage the jaws 38 may need to reach further to gasp the rod 14. For example, in FIG. 6, it can been seen that the axis 33 is further from the storage 16 than it is in FIG. 7. In this case the boom carriage 36 is able to travel along the boom 32 so as to provide this reach.

Under the control of the processor an actuator is actuated causing the boom carriage 36 to run along the boom 32 as indicated by arrow Q. One or more sensors associated with the boom 32 or boom carriage 36 report on the position of the boom carriage 36 relative to the boom 32 so that the boom carriage 36 can be correctly positioned.

In an embodiment, to grasp the rod 14, under the control of the processor, an actuator in each of the jaws 38 is activated so as to open the jaws 38. The sensor of each jaw 38 reports the state of the jaws 38 to the processor.

The boom carriage 36 may then be lowered in the direction of arrows R so that the jaws 38 contact the rod 14. This occurs by an actuator 70 at each end of the carriage 36 releasing a respective clamp on a respective bearing thus allowing this movement.

The jaws 38 may be activated so as to grasp the rod 14.

In an alterative, the clamps may simply allow upward movement of the bearings so as to account for any tilt on the boom 32 and misalignment of the boom 32 to the rod 14.

The boom 32 may then be raised to clear the rod 14 from the storage 16 by moving the carriage 34 up the mast 20 in a similar manner as is described above. The boom 32 may then be rotated about axis 33 so as to be parallel with the mast 20.

As this point, the alternative to the rod 14 being taken from the rig 10 will be described, that is the rod 14 is taken from the truck 12.

The user may provide an input to the user input device to indicate to the processor that the rod 14 should be taken from the truck storage 16. The input may also indicate the position of the truck 12. Initially the position of the truck 12 will be described as shown in FIGS. 1 to 3.

In this case then the boom 32 is slewed out 1806 so as to be beside the mast 20, the jaws 38 will be facing the truck 14 and so they will not be facing in the wrong direction as is the case when the rod 14 is taken from the rig storage 18. Accordingly no rotation as indicated by arrow O need occur.

Again, depending on the height of the rod 14 to be taken relative to the height of the axis of rotation 33 and the angle of the mast 20 relative to horizontal, the two movements of the mast height and the rotation of the boom 32 to the vertical (or parallel to the truck) may be required. These can occur as described above, although it is noted that the angle of rotation of the boom 32 relative to the mast 20 will be in the opposite direction.

Reaching into the storage 16, grasping of the rod 14 and raising of the boom 32 when the rod 14 is grasped by the jaws 38 so as to be parallel with the mast 20 will be essentially the same as described above.

Now, in either case of the rod being taken from the truck 12 or the rig 10, the rod 14 may be slewed into position in the mast 20.

Under the control of the processor, axle 48 is rotated so as to slew the slew arms 42 and 54 and boom 32 into position in the mast 20.

If there were no second slew arm 54, the rod 14 may not be perfectly aligned with an operating position once slewed back, particularly when the mast 20 is at an angle. This may be due to deflection along the length of the boom 32. To counter this, the support 52 may be lowered so as to engage the post 62 at the upper end of the boom 32. In this way the boom 32 is supported at both ends to minimise deflection. Typically the support 52 will be engaged with the post 62 before the boom 32 is slewed back the operating position.

The rod 14 may then be inserted in the drill string in the usual manner and the jaws 38 opened to release the rod 14 for operation. In some cases, an impact of the drilling rigs drill head on the rod 14 while it is being held can cause a jarring force to be inflicted on the rod handler 30. A shock absorber 60 may be positioned on the boom 32 to absorb this force in the direction indicated by arrow T so as to prevent damage to the rod handler 30.

Figure 13:
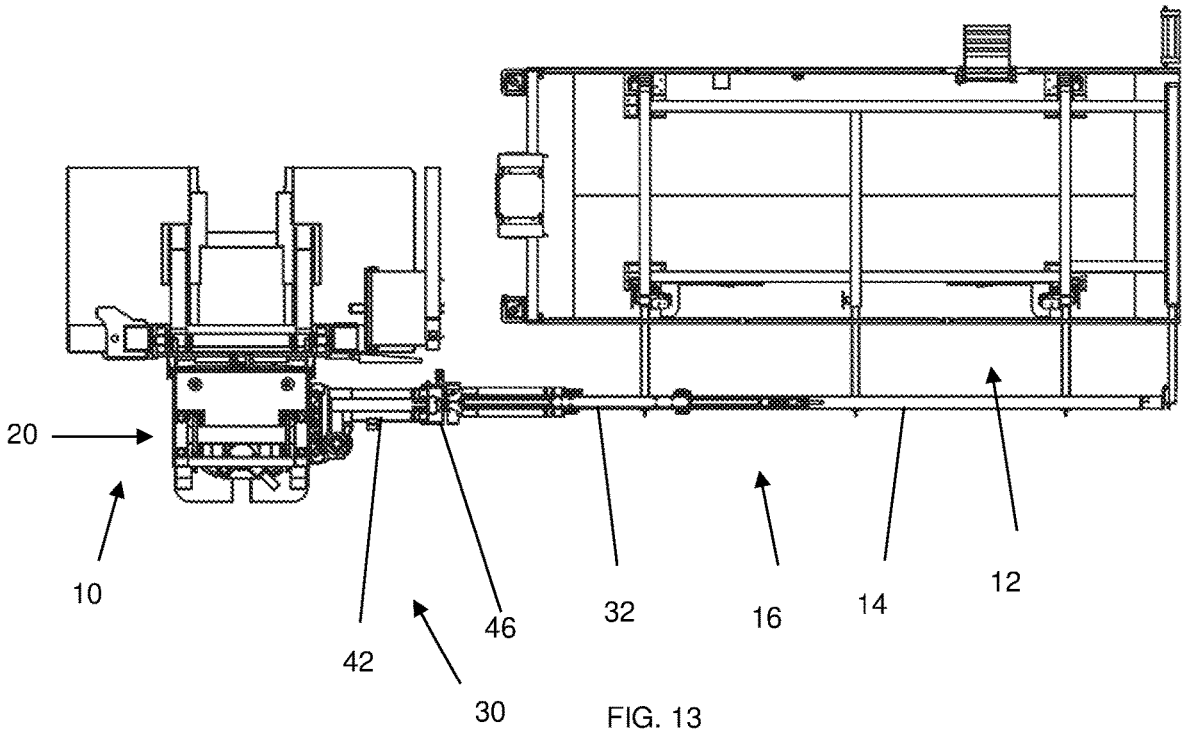
FIG. 13 comprises a plan view of a mast end portion of the drilling rig and a rear end portion of the truck of FIG. 1, with the truck in an orthogonal position relative to the rig.

Referring to FIG. 13, here the truck 12 is positioned orthogonal to the length of the rig 10. In this case the boom 32 is slewed out about 90é so as to be orthogonal to the length of the rig 10. The jaws 38 will be facing the truck 14 and so they will not be facing in the wrong direction as is the case when the rod 14 is taken from the rig storage 18. Accordingly no rotation as indicated by arrow O need occur.

The rod 14 may be taken or returned to the truck storage 16 in the same manner as described above, except that when the boom 32 is slewed back to place the rod 14 in the operational position, it only rotates 90é instead of 180é.

In an alternative to use of the computer to automatically control the movements, they may be manually controlled by the user manually activating in turn the required actuators of the rod handler 30. In a further alternative, the computer and sensors may be used in a semi-automatic control in which the user is assisted in progressing the movement stages, but progression from one movement stage to the next is supervised by the user, and the user has the ability to intervene.

To return a rod 14 to one of the storages 16 or 18 the process of taking the rod is reversed.

Referring to FIGS. 14 to 18, an alternative rod handler 30 is described. The main difference is that instead of slewing the rod into the operative position, a drill head 80 retrieves the drill rod as it is presented by the rod handler 30.

In this second embodiment, the boom positioner comprises a boom tilt mechanism for raising and lowering the boom 32 relative to the mast 20. In an embodiment, the boom positioner comprises a height adjuster for adjusting the height of the boom tilt mechanism relative to an end of the mast 20. In an embodiment, the boom positioner comprises a boom swivel mechanism for positioning the boom 32 and its jaws 38 in the desired orientation.

Figure 15:
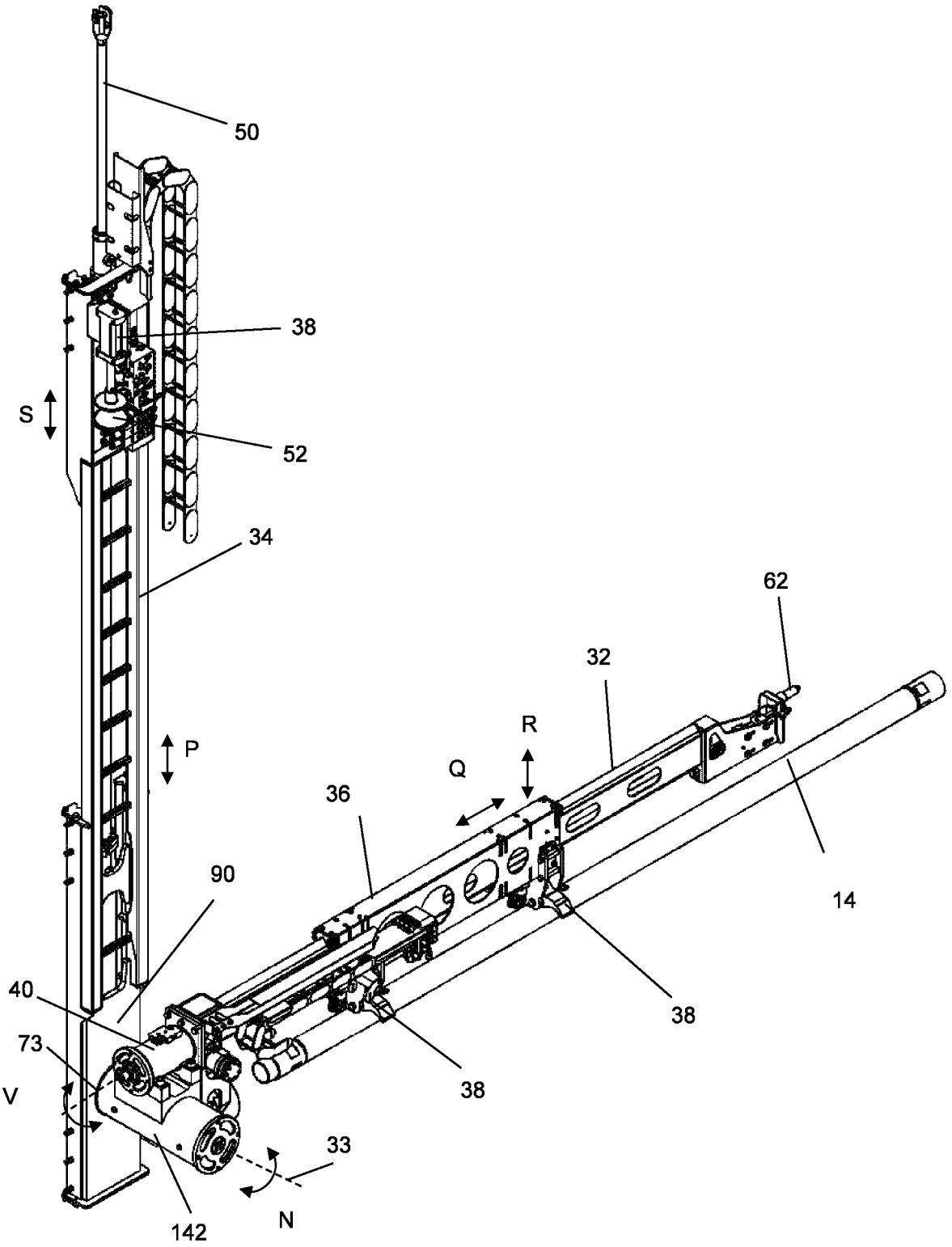
FIG. 15 is an enlargement of the rod handler of FIG. 14.
Figure 16:
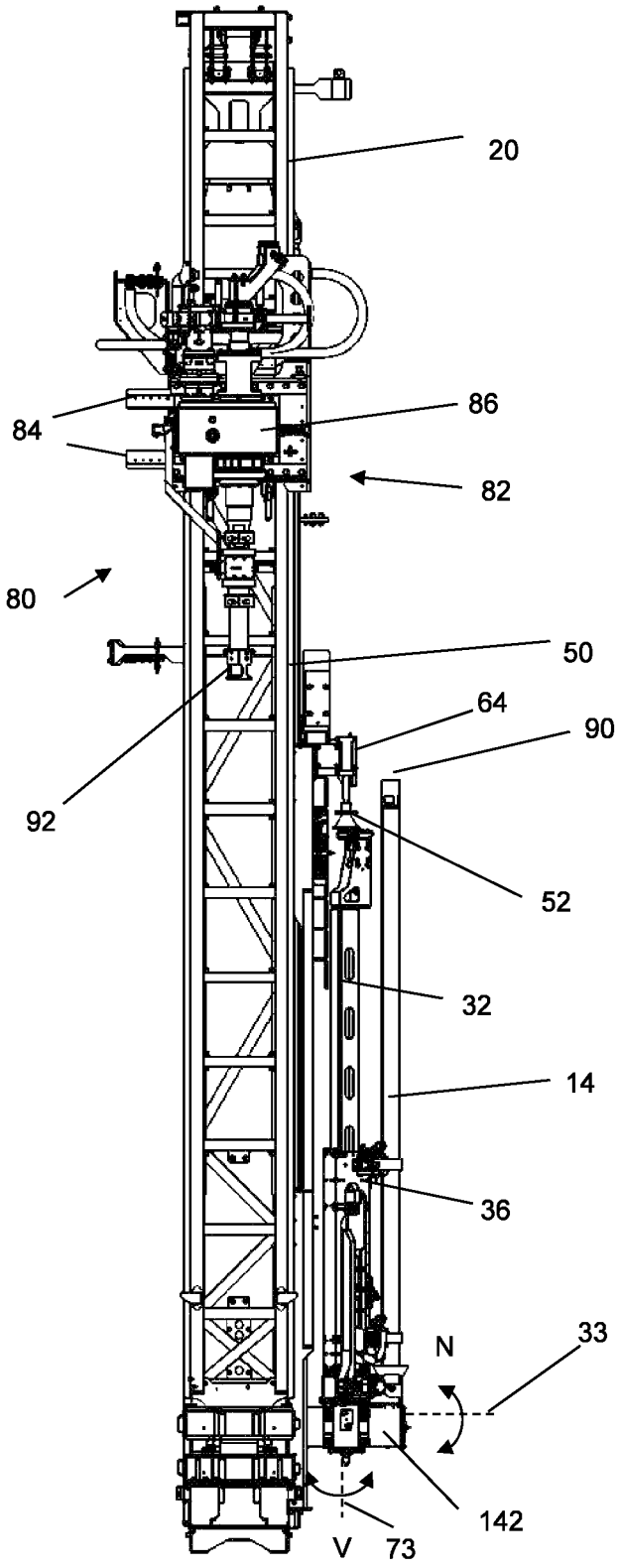
FIG. 16 is an end view of the mast and rod handler of FIG. 14, with the rod being in a raised position.
Figures 17, 18:
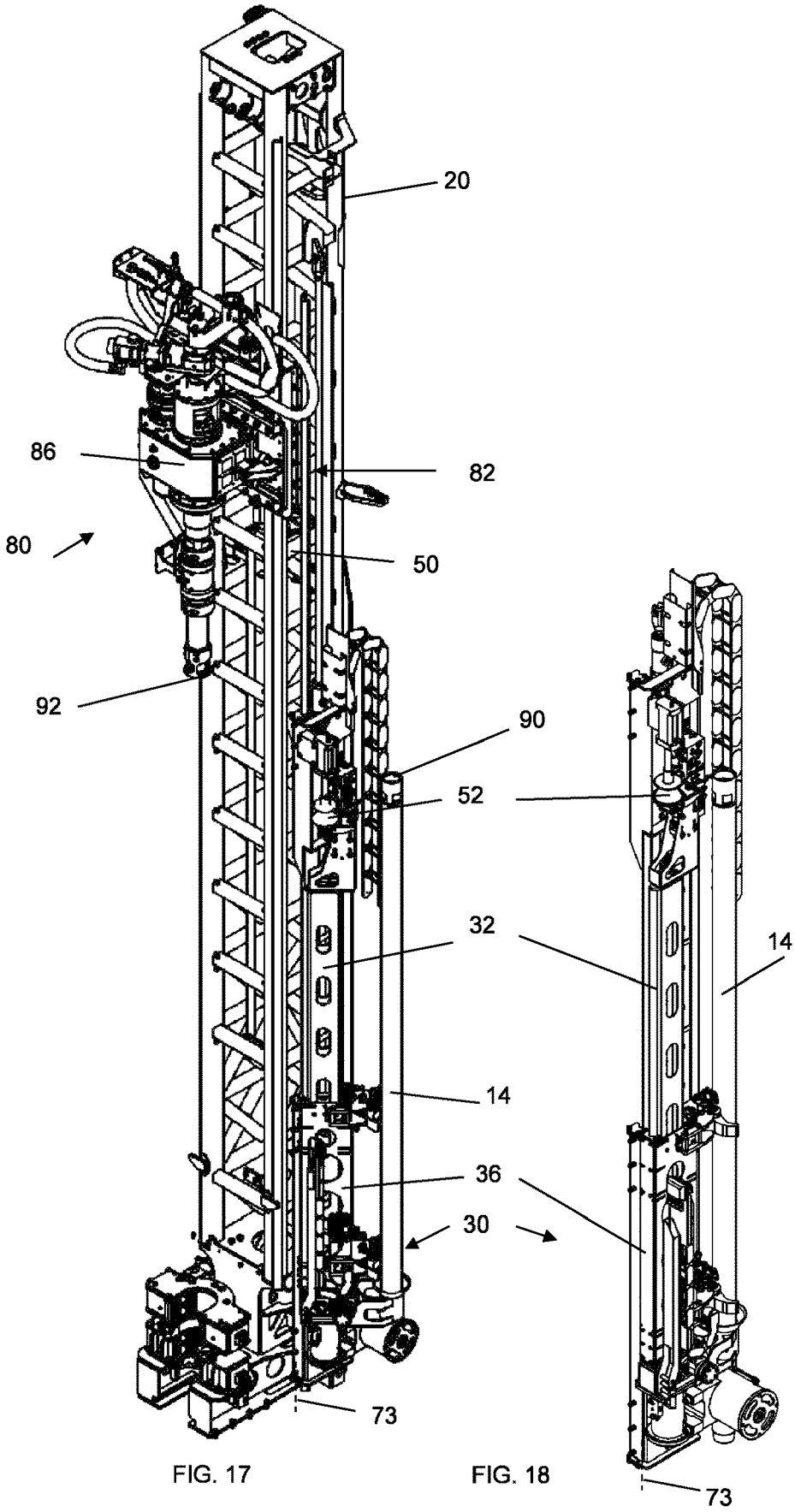
FIG. 17 is a perspective view of the mast and rod handler of FIG. 16.
FIG. 18 is a perspective view of the rod handler of FIG. 17.

As seen in FIG. 15, the end of the boom at the post 62 is lowered and the boom swiveled so that the jaws 38 face downward. The jaws 38 have grasped, or can release the drill rod 14. The tilt mechanism comprises a pivotable actuator 142, which is able to pivot the boom 32 about axis 33 as shown by arrow N.

The boom swivel mechanism comprises pivotable actuator 40, which is able to swivel the length of the boom 32 about axis 73 as shown by arrow V. Axis 73 substantially coincides with the length of the boom 32. The swivel mechanism is able to change the facing of the rod 14 from a lifted position in which it has a facing towards rod storage to a rod presentation position where it has the rod presentation facing. The rod presentation facing allows a drill interface 92 to attach the drill rod 14 to the drill rod string.

The drill head 80 has rod collection mechanism 82. The rod collection mechanism is in the form of a body 86 movable laterally with respect to the mast 20 on rails 84. This allows the drill interface 92 to move over the presented drill rod 14, descend and be coupled to the drill rod 14. The drill rod 14 can be released from the jaws 38 and the drill head 80 can then take the drill rod 14 to the operational position 22.

In order for the drill interface 92 to correctly couple to the drill rod 14, the drill rod 14 must be correctly positioned in the presentation position. This is where the support 52 interconnects the end of the boom 32 to the mast 20, thereby correctly positioning the boom 32 and stabilises the end of the boom 32 with respect to the mast 20.

In an embodiment, the boom 32 comprises a boom carriage 36 for carrying the jaws 38 on the boom 32. In an embodiment, the boom carriage 36 is configured to travel along the length of the boom 32 as indicated by arrow Q.

In an embodiment, the mast 20 comprises a mast carriage 34 for carrying a plate 90 to which is connected the actuator 142. In an embodiment the mast carriage 34 is configured to travel along the length of the mast 20 so as to position the actuator 142, and thus the boom 32, with respect to the mast 20 as indicated by arrow P.

Again, the boom carriage 36 may be able to tilt relative to the boom 32 to account for a misalignment so that each end is independently, controllably able to move as indicated by arrows R.

The upper end of the boom 32 again comprises the post 62 which may be engaged by a support 52 at the end of an arm 54 fixed to the carriage 34. In an embodiment the support 52 is cone, umbrella or bell shaped so as to receive the post 62 even if the boom 32 is deflected. The support 52 is telescopically extendable so as to engage or disengage with post 62 as indicated by arrow S.

In this embodiment the sensors may be, for example, positioned as follows:

Along the length of the track 50 so that there is feedback to the processor on the position of the carriage 34 along the line indicated by arrow P;

Within the actuator 142 so that the rotational position of the boom 32 relative to the mast 20 (or carriage 34) (and within the arc indicated by the arrow N) is known by the processor;

Within the actuator 40 so that the swivel position of the boom within the arc indicated by arrow V is known by the processor;

Along the length of the boom 32 so that the position of the boom carriage 36 along the length of the boom 32 as indicated by arrow Q is known by the processor;

On the boom carriage 36 so that the position of the carriage 36 within the plane of the carriage 36 and perpendicular to the direction of arrow Q relative to the boom 32 (and within the plane through which parallel arrows R pass) is known by the processor;

Where the jaws 38 are extendable within the plane through which the arrows R pass, on the carriage 36 so that the position of the extension of each jaw 38 is known by the processor;

On the jaws 38 so that the state or degree by which each jaw is opened or closed is known by the processor; and On the support 52 so that the extension of the support 52 relative to the second slew arm 54 within the line indicated by arrow S is known by the processor.

The method of operation and use of this embodiment of the rod handler 30 will now be described in more detail with reference to the figures.

Figure 14:
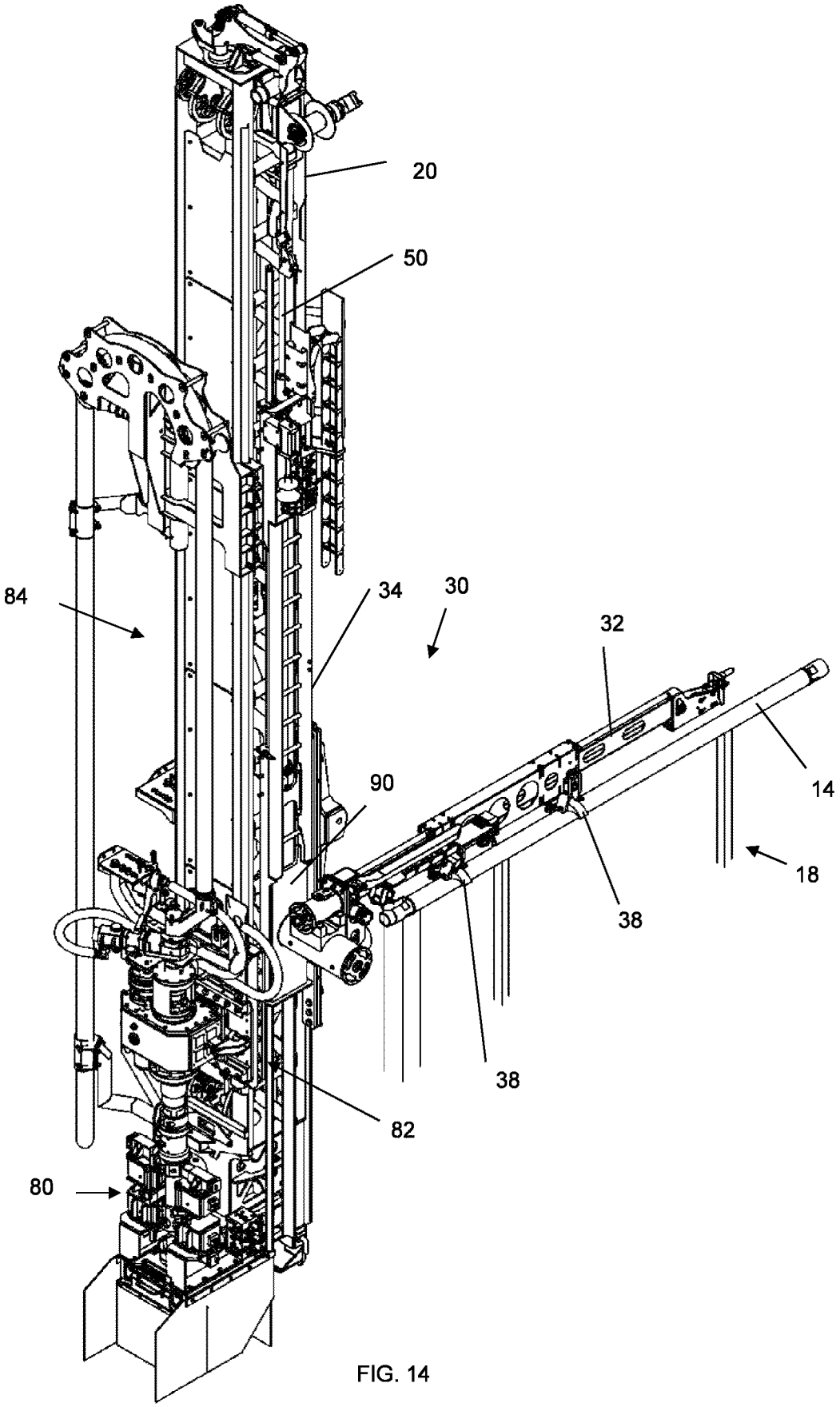
FIG. 14 is perspective view of a mast and rod handler of a drilling rig according to an alternative embodiment of the present invention, with a drill rod being positioned in a rod storage.

Referring to FIGS. 14 and 15, if necessary, the boom 32 is positioned at the correct height relative the mast 20. The boom 32 is swiveled so that the jaws 38 are facing the storage 18. The boom 32 is lowered to the storage 18. The boom carriage 38 is moved along the boom 32 as necessary. The jaws 38 are closed on the drill rod 14. The rod handler 30 now has grasped the drill rod 18.

The tilt actuator 142 then lifts the boom 32 so that it is substantially parallel with the mast. The boom carriage 36 lowers to a home position. The swivel actuator 40 swivels the boom 32 to the presentation position. The mast carriage 34 lowers to a home position. The support 52 extends to engage the post 62, thereby securing the boom 32 relative to the mast 20. The rod 14 is now ready to be taken by the drill head 80.

The drill head 80 is positioned at the correct height on the mast 20. The body 86 runs along the rails 84. The drill interface 92 is lowered to couple to the drill rod 14. The jaws 38 release the drill rod 18. The body 86 then runs back along the rails 84 so that the rod is in the operational position 22. The drill rod 14 can then be used in the drilling operation.

When the drill rod 14 is finished in the drilling operation, the rod can be put away in the storage as follows. The drill head 80 is positioned at the correct height on the mast 20. The body 86 runs along the rails 84. The drill rod 14 is then in the presentation position. The boom 32 is positioned in the upright position and the jaws 38 are swiveled if necessary to grasp the drill rod 14. The drill interface 92 is de-coupled from the drill rod and raised clear of the drill rod 14. The drill head 80 then returns to operations by moving the body 86 back along the rails 84. The drill rod 14 can then be put away in storage.

If storage 18 is used, the boom 32 is swiveled. The mast carriage 32 may be used to adjust the height of the tilt mechanism. The tilt actuator 142 then lowers the boom 32. The boom carriage 36 may be used to extend the reach of the boom 32. The jaws 38 can then release the drill rod 14 into the storage 18.

If storage 16 is used, the boom 32 does not need to be swiveled. The mast carriage 32 may be used to adjust the height of the tilt mechanism. The tilt actuator 142 then lowers the boom 32, this time in the direction of the truck 12. The boom carriage 36 may be used to extend the reach of the boom 32. The jaws 38 can then release the drill rod 14 into the storage 16.

Modifications may be made to the present invention with the context of that described and shown in the drawings. Such modifications are intended to form part of the invention described in this specification.

In this specification, the term 'means is intended to be inclusive and not exclusive or exhaustive, and to for example mean any manner by which the person skilled in the art would envisage as achieving the particular objective of that means, based on the teaching of the specification, but not limited to only the particular embodiments taught by the specification. In particular, in any jurisdiction in which 'means plus function' language is considered to be limiting, the specification contemplates use of substitute language that is not intended to be so limiting.

The invention claimed is:

1. A drill rod handler for use on a drilling rig comprising:

a boom having jaws for releasably grasping a drill rod in at least two spaced apart positions along the length of the drill rod;

a boom positioner configured to position the boom so that the jaws may grasp a drill rod from each of at least two different selectable positions, the selectable positions comprising: a first rod storage position on the drilling rig that holds drill rods in a substantially horizontal orientation and a second rod storage position at a different location that holds drill rods in a substantially horizontal orientation at a different angular orientation relative to the drilling rig in the horizontal plane to the angular orientation of the drill rods in the first rod storage position.

2. A drill rod handler according to claim 1, wherein the boom is pivotally connected at one end and free at the other end and when grasping the drill rod with the spaced apart jaws is parallel to the drill rod; and wherein the boom positioner is also configured to position the boom vertically or at an oblique angle to the vertical for the drill rod to be used or taken from use in a drilling operation.

3. A drill rod handler for use on a drilling rig comprising:

a boom having jaws for releasably grasping a drill rod in at least two spaced apart positions along the length of the drill rod, the boom having a first end and a second end;

a boom tilt for pivotally raising or lowering the first end of the boom and a drill rod when the drill rod is grasped by the jaws;

the boom tilt pivoting about a point at or adjacent to the second end; and an interconnect for connection to the first end of the boom for stabilising the first end of the boom with respect to a mast of the drilling rig when the boom is in a rod presentation position, the interconnect forming a connection to the first end of the boom when moved to a connected position, wherein the interconnect is moveable with respect to the mast so as to form the connection with the first end of the boom;

the boom tilt being pivotable about a first axis for raising or lowering the first end of the boom when the drill rod is grasped by the jaws; and pivoting about a second axis different to the first axis at or adjacent to the second end to present the boom in a rod presentation position.

4. A drill rod handler according to claim 3, wherein the interconnect connects to the boom when the boom has been raised and pivoted about the second axis.

5. A drill rod handler according to claim 3, wherein the rod handler further comprises a boom swivel for rotating the boom about its length so as to change the facing of the rod from a lift facing to a rod presentation facing.

6. A drill rod handler according to claim 5, wherein the boom swivel mechanism is orthogonally pivotal relative to the boom tilt.

7. A drill rod handler according to claim 4, wherein the connection of the interconnect to the first end of the boom connects the end of the boom relative to the mast, thereby stabilising the first end of the boom with respect to the mast.

8. A drill rod handler according to claim 4, wherein the boom comprises a boom carriage for carrying the jaws on the boom, wherein the boom carriage is configured to travel along the length of the boom.

9. A drill rod handler according to claim 4, wherein the mast comprises a mast carriage for carrying the boom tilt on the mast, the mast carriage being configured to travel along the length of the mast, wherein the mast carriage comprises the interconnect and is spaced from the rod tilt.

10. A drill rod handler according to claim 4, wherein the boom tilt moves the boom to a substantially horizontal orientation so that the rod may be deposited in the rod storage on the drilling rig or the other rod storage.

11. A drill rod handler according to claim 4, wherein the boom tilt mechanism is configured to allow the boom to be positioned at a selected angle relative to horizontal.

12. A drill rod handler according to claim 4, wherein the jaws are configured to traverse along at least a portion of the length of the boom.

13. A drill rod handler for use on a drilling rig comprising:

a boom having jaws for releasably grasping a drill rod in at least two spaced apart positions along the length of the drill rod, the boom having a first end and a second end;

a boom tilt for pivotally raising or lowering the first end of the boom and a drill rod when the drill rod is grasped by the jaws;

the boom tilt pivoting about a point at or adjacent to the second end; and an interconnect for connection to the first end of the boom for stabilising the first end of the boom with respect to a mast of the drilling rig when the boom is in a rod presentation position, the interconnect forming a connection to the first end of the boom when moved to a connected position, wherein the interconnect is moveable with respect to the mast so as to form the connection with the first end of the boom;

wherein the mast comprises a mast carriage for carrying the boom tilt on the mast, the mast carriage being configured to travel along the length of the mast, wherein the mast carriage comprises the interconnect and is spaced from the rod tilt.

14. A drill rod handler according to claim 13, wherein the mast carriage operates as a height adjuster of the height of the boom relative to the mast.

15. A drill rod handler for use on a drilling rig comprising:

a boom having jaws for releasably grasping a drill rod in at least two spaced apart positions along the length of the drill rod, the boom having a first end and a second end;

a boom tilt for pivotally raising or lowering the first end of the boom and a drill rod when the drill rod is grasped by the jaws;

the boom tilt pivoting about a point at or adjacent to the second end; and an interconnect for connection to the first end of the boom for stabilising the first end of the boom with respect to a mast of the drilling rig when the boom is in a rod presentation position, the interconnect forming a connection to the first end of the boom when moved to a connected position, wherein the interconnect is moveable with respect to the mast so as to form the connection with the first end of the boom;

wherein the mast comprises a mast carriage for carrying the boom tilt on the mast, the mast carriage being configured to travel along the length of the mast, wherein the drill hold handler also comprises a boom positioner for moving the boom so that the drill rod may be moved to an operating position on the drilling rig; wherein the boom positioner comprises a slew for slewing the boom relative to a mast of the drilling rig, the slew comprising first and second slew arms; wherein the slew comprises a pivotal coupling of a first end of the slew arm to the mast carriage pivotally connected to the boom carriage such that the slewing is stabilised by two spaced apart pivotal connections between the booms and the mast carriage.

16. A drill rod handler according to claim 15, wherein the slew arms are configured to move the jaws in to or out of the operational position.

17. A drill rod handler according to claim 15, wherein the interconnect further comprises a rod aligner for aligning the rod with the mast and at an angle relative to the boom when in the presentation position.

18. A drill rod handler according to claim 17, wherein the rod aligner comprises an extendable support for engaging the first end of the boom in order to prevent movement of the first end of the boom in the horizontal plane when engaged.

19. A drill rod handler according to claim 18, wherein the first end of the boom comprises a post for engagement with the extendable support.

20. A drill rod handler according to claim 18, wherein the extendable support releases engagement of the post of the boom so as to disengage the boom when extendable support is retracted so that the boom tilt can be operated.

21. A drill rod handler according to claim 17, wherein the rod aligner comprises the second slew arm, wherein the second slew arm is able to releasably engage the first end of the boom.

22. A drill rod handler according to claim 17, wherein the rod aligner comprises an arm constrained in relation to the mast, wherein the fixed arm is able to releasably engage the first end of the boom.

23. A drill rod handler according to claim 15, wherein the second slew arm is coupled to the first slew arm by an axle coupled to the mast carriage such that the slew arms slew the boom in unison when the second slew arm engages the boom by movement of the interconnect to connect the second slew arm to the first end of the boom.

* * * * *